United States Patent [19]

Capdevielle et al.

[11] 4,091,952

[45] May 30, 1978

[54] TANK STRUCTURE FOR THE STORAGE AND DISTRIBUTION OF SEVERAL FLUIDS, PARTICULARLY HYDROCARBONS

[75] Inventors: Pierre Capdevielle, Garches; François Kermarrec, Rueil-Malmaison, both of France

[73] Assignee: Institut Francais du Petrole des Carburants et Lubrifiants and Societe Anonyme Pour Tous, Appareillages Mecaniques (Satam), France

[21] Appl. No.: 321,965

[22] Filed: Jan. 8, 1973

Related U.S. Application Data

[63] Continuation-in-part of Ser. No. 107,740, Jan. 19, 1971, abandoned, which is a continuation-in-part of Ser. No. 887,679, Dec. 23, 1969, abandoned.

[30] Foreign Application Priority Data

Dec. 3, 1968 France ..... 68.183004

[51] Int. Cl.[2] ..... B65D 4/16; B65D 2/46

[52] U.S. Cl. ..... 220/22; 220/402; 220/85 B

[58] Field of Search ..... 220/22, 63 R, 85 B, 220/85 A, 20, 63, 65, 16, 17; 114/74 R, 74 T; 222/94, 95, 129, 386.5; 150/1

[56] References Cited

U.S. PATENT DOCUMENTS

| | | | |
|---|---|---|---|
| 2,545,710 | 3/1951 | Snyder | 206/205 |
| 3,091,923 | 6/1963 | Barnes | 222/94 |
| 3,131,741 | 5/1964 | Darling | 150/1 |
| 3,144,953 | 8/1964 | Taylor | 220/85 B |
| 3,172,556 | 3/1965 | Stiefel | 220/85 B |
| 3,266,671 | 8/1966 | Gelpey | 229/95 |
| 3,356,251 | 12/1967 | Roberts | 220/63 R |
| 3,421,661 | 1/1969 | Price | 222/95 |
| 3,494,509 | 2/1970 | McGuire | 220/95 |
| 3,590,888 | 7/1971 | Coleman | 220/63 R |
| 3,658,080 | 4/1972 | Mitchell | 220/85 B |

FOREIGN PATENT DOCUMENTS

| | | | |
|---|---|---|---|
| 1,080,122 | 8/1967 | United Kingdom | 150/.5 |

*Primary Examiner*—George E. Lowrance
*Attorney, Agent, or Firm*—Craig & Antonelli

[57] ABSTRACT

A tank structure for the storage and distribution of a plurality of fluids from several storage chambers located in an enclosure, wherein said chambers are constituted by several bags placed inside one another and formed by at least one fluid-tight wall made of a flexible material which, when unfolded, substantially fills the whole internal volume of the enclosure without being subjected to excessive stresses, said bags being provided with inlet and outlet valves for fluids stored in said chambers, said bags being surrounded by a housing at least one chamber forming an auxiliary chamber fed with pressurized auxiliary fluid from a source outside said housing, said pressure being transmitted from said auxiliary fluid to said fluids stored through said walls of flexible material of said bags.

19 Claims, 8 Drawing Figures

TANK STRUCTURE FOR THE STORAGE AND DISTRIBUTION OF SEVERAL FLUIDS, PARTICULARLY HYDROCARBONS

The present application is a continuation-in-part application of application Ser. No. 107,740 filed Jan. 19, 1971, now abandoned, which is a continuation in-part application of application Ser. No. 887,679 filed Dec. 23, 1969 now abandoned.

The present invention relates to a new tank structure permitting storage of a plurality of fluids without any contact between these fluids, this structure being specially adapted to the application of a process wherein each of said fluids is delivered by means of an auxiliary pressurized fluid forcing out of the tank the fluid to be distributed.

A tank according to the invention may, in particular, be used for storing and distributing hydrocarbons in a storage plant, such as, for example, in a filling station, but it should be understood that this particular application, which will be described in detail in the following, does not constitute any limitation for the invention.

The main object of the present invention is to permit the distribution of each of said fluids separately by means of one and the same pressurized auxiliary fluid.

An additional object of the invention is to separate the fluids to be distributed and the auxiliary fluid, so as to suppress the risks of the formation of emulsions and of the dissolution into the auxiliary fluid of some components of the fluids to be distributed, this emulsion and this dissolution being liable to occur at the interfaces between the fluids in contact with one another.

Another object of the invention is to suppress the risks of a pollution of the fluids to be distributed, through the auxiliary fluid.

These objects are achieved, according to the invention, with a tank structure for storing and delivering a plurality of fluids, including a container surrounding several fluid-tight chambers of variable volume provided with supply and discharge means for the fluids stored in said chambers and at least one auxiliary chamber connected to a source delivering an auxiliary pressurized fluid maintaining the stored fluids under a substantially steady pressure, this auxiliary chamber forming with said storage chambers an assembly of adjacent chambers separated from one another through membranes of very small stiffness, adapted to continuously provide for a substantial equalization of the pressure in the different chambers, said storage and auxiliary chambers being limited by bags of flexible material, placed inside one another and comprising an outer bag within said container, the wall of each bag having a sufficient surface to make possible the expansion of said bag, when filled with fluid, substantially to the whole internal volume of said container, without subjecting the material of which is formed the bag, to excessive stresses.

Non limitative embodiments of the invention will be described hereinunder more in detail, with reference to the attached drawings, wherein:

FIG. 1 illustrates a filling station provided with a tank according to the present invention, FIG. 2 is a cross-section of a first embodiment of the invention, FIG. 2A illustrates the tank of FIG. 1, only one bag being filled with fluid, FIG. 3 shows another embodiment of the invention with an alternative embodiment of the arrangement of the supply and discharge pipes, FIGS. 4 to 7 illustrate a preferred embodiment of the arrangement of the supply and discharge pipes.

The same reference numerals designate like elements in the different drawings.

In FIG. 1, illustrating a filling station provided with a tank according to the present invention, the tank is buried and located in a safety pit I and includes a housing 2 of flexible or rigid material, for example constituted by a metallic tubular container, this housing containing an auxiliary fluid kept under pressure for the discharge of three storage chambers located in the tank (this number of storage chambers being obviously not limitative) which contain different fluids such as, respectively, ordinary gasoline, premium grade gasoline, or gasoline having a high octane number, and gas oil.

The storage chamber of the tank may be filled up with hydrocarbons through the pipes 6, 7 and 8 respectively, by pumping these hydrocarbons through pumps 9, 10 and 11. The distribution of the pressurized hydrocarbons will be effected from the distribution places 12, 13 and 14 through the distribution pipes 15, 16 and 17.

By actuating the valves 18, 19, 20 and the valves 12*a*, 13*a* and 14*a*, it is possible to switch from the position for filling the tank storage chambers to the position for distributing the fluids contained in these storage chambers and vice-versa.

An auxiliary pressurized fluid supplied through the pipe 21 into the housing 2, enables the hydrocarbons contained in each of these chambers to be kept under pressure, thereby allowing their distribution by simply opening a valve (valve 12*a*, 13*a*, 14*a*) at each of the distribution places 12, 13 and 14.

This auxiliary fluid may be constituted by a gas under pressure, such as, for example, compressed air or by a liquid.

In the considered embodiment the auxiliary fluid is water under pressure supplied from a water tower 22.

This water tower is provided with an overflow 23 for maintaining a constant water level in the main tank 24.

Under the water tower 22, a tank 25 receives the overflow from the main tank 24, which is supplied from the secondary tank 25 through a pump 26.

FIG. 2 shows a cross-section of the tank structure according to the invention, having an elongated shape (as represented in FIG. 1) or a spherical shape.

The three storage chambers 3, 4 and 5, wherein are respectively stored gas oil, premium grade gasoline or gasoline having a high octane number and gas oil, are constituted by the three bags 27, 28 and 29 respectively placed inside one another and surrounded by the housing 2.

The three walls of bags 27, 28 and 29 are folded on themselves and connected to the internal wall of container 2 substantially at one and the same point or along a same fixation line (along one and the same generatrix in the case of a cylindrical tank).

Reference numerals 30 to 33 designate the pipes used for the supply and discharge of the fluids stored in the bags and of the auxiliary fluid, such as water, introduced, for example, into the housing between the bag 27 and the container 2.

The bags are constituted by very small stiffness membranes of flexible material designed with sufficient surface so as to expand to substantially the whole internal volume of the container 2 for permitting an expansion of any chamber substantially to the whole volume of the housing 2, when said gas is filled up with fluid as represented in FIG. 2A, and without subjecting the flexible material to excessive stresses. The expansion of any bag is obtained by application of the wall of said bag against the inner wall of the housing 2 under the effect of a small over pressure inside said bag or by the mere unfolding of the wall which is normally in a folded state when the capacity of said bag is partially used.

The walls of each of these storage chambers are constituted, at least partly, by a membrane of deformable material, which may or not be elastic, capable to resist to the hydrocarbon which is contained therein.

One may for example use, for constituting these membranes, materials made of synthetic polymers, such as elastomeric and thermoplastic materials resisting to hydrocarbons. It will possible to select an elastomer of the non-limitative following list:

"Kel-F" (trade name for the copolymer of fluorovinylidene and monochlorotrifluorethylene), "Viton" (trade name for the copolymer of fluorovinylidene and hexagluoropropylene), "Fluorosilastene" (trade name for polyfluorosiloxane), "Silicone" (trade name for polysiloxane), "Hypalon" (trade name for chlorosulfonated polyethylene), "Perbunan" or "Hycar" (trade names for butadiene or acrylonitrile), "Neoprène" (trade name for polychloroprene), natural rubber (natural polymer of isoprene), "Butyl" (trade name for the copolymer of isobutylene and isoprene), polyurethane, "Rilsan" (or "Polyamide 11"), etc . . . .

It will also be possible to choose a plastic material having a good flexibility, such as polyethylene, polyvinylchloride, polypropylene.

More particularly, there will be used a high molecular weight polyethylene, a polyamide of the type known under the trade mark Rilsan, or the 11-polyamide, the vinylidene polychloride or the ethylene glycol polyterephtalate.

These materials have a good resistance to the attack by hydrocarbons in general, as well as by the water used as auxiliary pressurized fluid.

The thickness of said flexible walls limiting the various storage chambers of the tank will be for example between 20 and 500 microns, in most cases between 50 and 150 microns, and particularly around 100 microns.

The flexible wall separating the hydrocarbons stored in the tank structure from the water used as auxiliary pressurized fluid will advantageously consist of composite membranes formed, for example of a polyethylene film which constitutes a substantially water-proof seal, coupled with a polyamide such as Nylon (trade mark), hydrocarbon proof, or of a polyethylene film (water-proof) associated to a film Rilsan (11-polyamide), etc . . . these examples being, however, not limitative.

In such an embodiment, the flexible wall will be so positioned that the water-proof film is placed in contact with water while the hydrocarbon-proof film must be on the side in contact with hydrocarbons.

By selecting, for constituting the various chambers of the tank, bags formed of thermoplastic material having each a maximum capacity substantially equal to the internal volume of housing 2, these bags (FIGS. 2 and 2A) may be utilized in any proportion of their maximum capacity for storing separate fluids (the walls of the various bags thus forming folds as indicated in 34 in FIG. 2) and it will be still possible to store a single fluid in the tank, for example, in bag 27 which may than be used nearly at its maximum capacity (FIG. 2A) by mere unfolding of its wall without subjecting the same to any other stresses than those resulting from a very small differential pressure, only a very small residual volume 35 being left for the pressurized auxiliary fluid between said bag wall and the internal wall of housing 2.

The other storage bags (28 and 29) are accordingly collapsed inside bag 27 (FIG. 2A).

It is also possible to make use of any other bag such as 28 or 29 substantially at its maximum capacity in place of bag 27.

In the embodiment of FIG. 2, means such as springs 36 to 39 are provided to prevent obstruction of the pipes 30 to 33 by the walls of the bags in which fluids have to be introduced.

FIG. 3 shows a different arrangement for the supply to and discharge from the different chambers of a tank according to the invention.

Pipes 30*a* to 33*a*, supplied with fluid through the mouthpieces 30*b* to 33*b* respectively, are arranged substantially coaxially.

The choice of the materials constituting these pipes will be made by those skilled in the art for each particular utilization and it should be decided in each particular case whether flexible or rigid pipes are to be used for constituting the pipes 20*a* and 33*a* arranged coaxially.

FIGS. 4 to 7 illustrate a preferred embodiment of the arrangement of the supply and discharge pipes and means connecting these pipes to the corresponding bags.

In FIG. 4 are shown in a perspective view four chambers, constituted by four bags 40 to 43 made of flexible material, having an elongated shape and placed inside one another. These bags are surrounded by the housing 2 (not shown).

In the illustrated embodiment, the bags 41 to 43 are used as storage chambers of fluids to be stored and the bag 40 is used as auxiliary chamber whereinto auxiliary pressurized fluid is introduced. The intake and discharge ports 44 to 47 of the bags 40 to 43 are concentrically placed and located, for example, at the upper part of the tank.

In the non-limitative embodiment shown in FIG. 4 the bags 40 to 43 are respectively extended by vertical sleeves 44*a* to 47*a* of flexible material so that the intake and discharge ports 44 to 47 are substantially placed at a same level.

It should be noted that these sleeves are not necessary when the intake and discharge ports are situated at one of the extremities of the bags.

After the bags have been positioned as illustrated in FIG. 4, the end portions of supply and discharge pipes 48 to 51 are introduced in the corresponding intake and discharge ports 44 to 47 of the bags 40 to 43 (FIG. 5), some distance being maintained between the different pipes.

A tight connection between the pipes and the bags is obtained by the locking, around the assembly of the pipes, of two complementary elements 52*a* and 52*b* having recesses 53*a* to 56*a* and 53*b* to 56*b* corresponding to the pipes 48 to 51.

The locking of elements 52*a* and 52*b* provides for a tight connection between the pipes 48 to 51 and the corresponding bags and simultaneously provides for the sealing of the bags in the vicinity of their intake and discharge ports.

The tank structure according to the invention, as hereabove described, offers the essential advantage of providing storage depots or tank assemblies with a high operation adaptiveness, since each tank may be used for storage as well of a single fluid as of several separate ones, without contact therebetween, each fluid filling any portion of the tank volume.

These tank compartments may be advantageously used for storing complementary amounts of fuels, i.e. fuels the consumptions of which vary oppositely, such as gasolines and fuel-oil used for heating purpose, these two types of fuel being subject to seasonal variations of their consumption with respective consumption peaks at different periods of the year; for example, in Europe a maximum consumption of gasoline during the summer season and a maximum consumption of fuel-oil during winter (more particularly in January and February). It is thus possible to reduce the overall capacity of storage required for both types of fuels by storing in at least two compartments of at least one tank of the aforesaid type, at least two fluids pertaining to groups of fluids whose seasonal consumption vary oppositely.

In such a tank the storage capacity left free by the withdrawal of one fluid pertaining to one group will be used for storing additional amounts of a fluid pertaining to the other group so as to take into account the seasonal variations of the consumptions.

From the foregoing description, one skilled in the art can ascertain the essential characteristics of this invention and, without departing from the spirit and scope thereof, can make various changes and modifications of the invention to adapt it to various usages and conditions. Consequently such changes and modifications are properly, equitably and intended to be within the full range of equivalence of the following claims.

Figure 1:
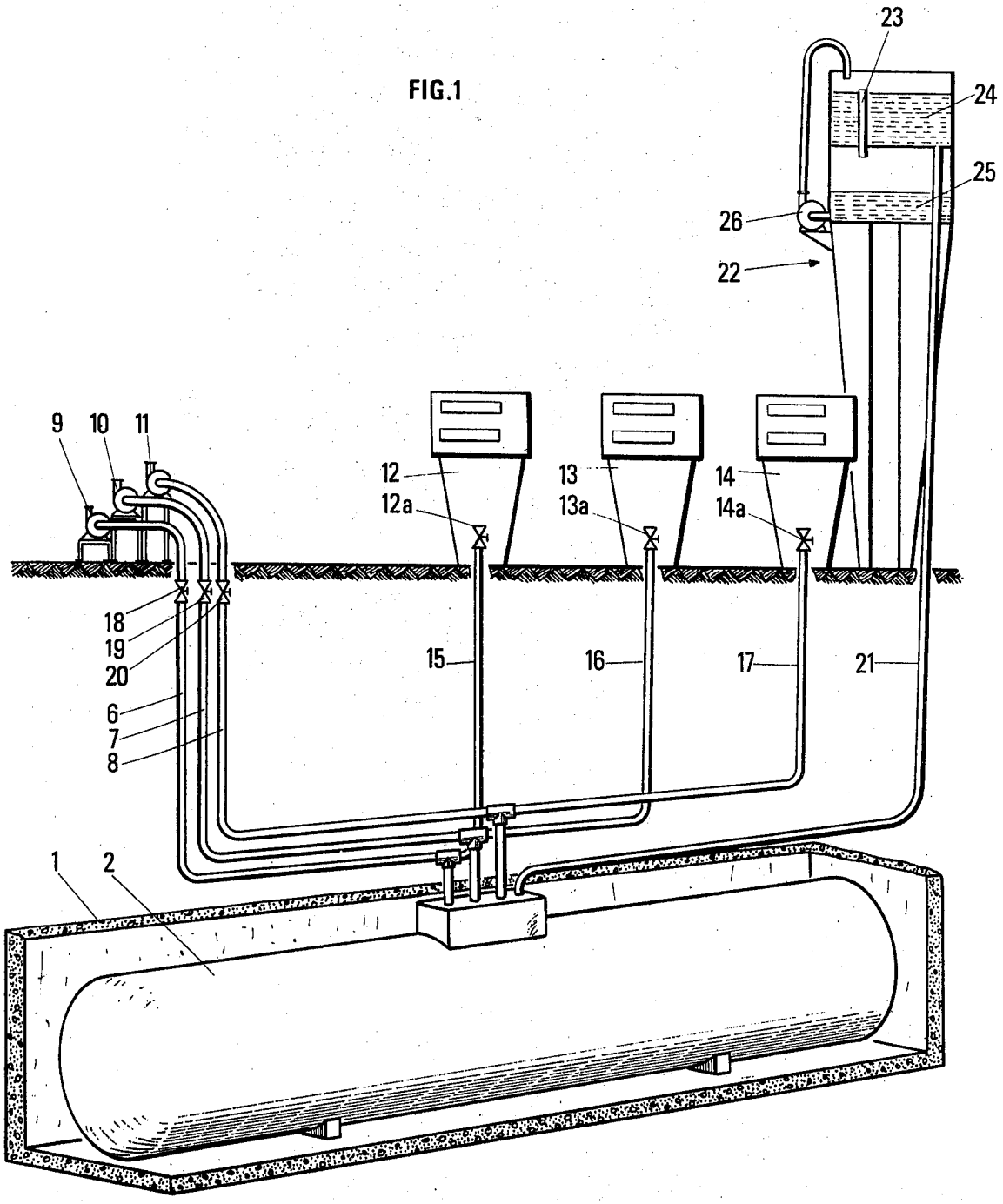
Figure 2:
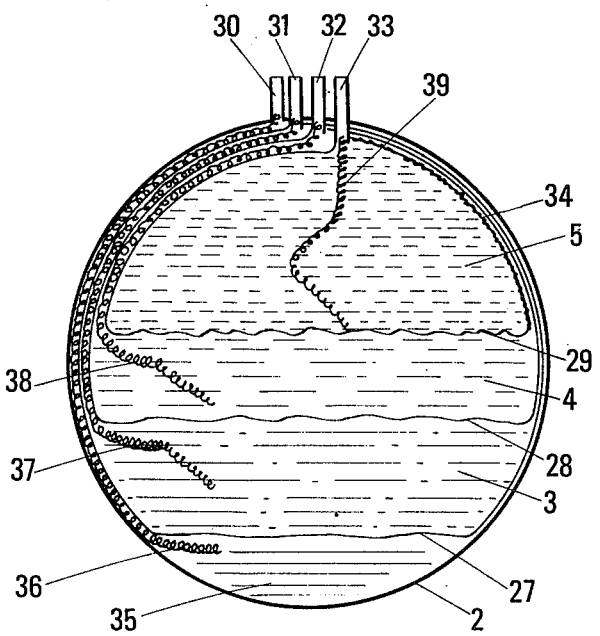
Figure 3:
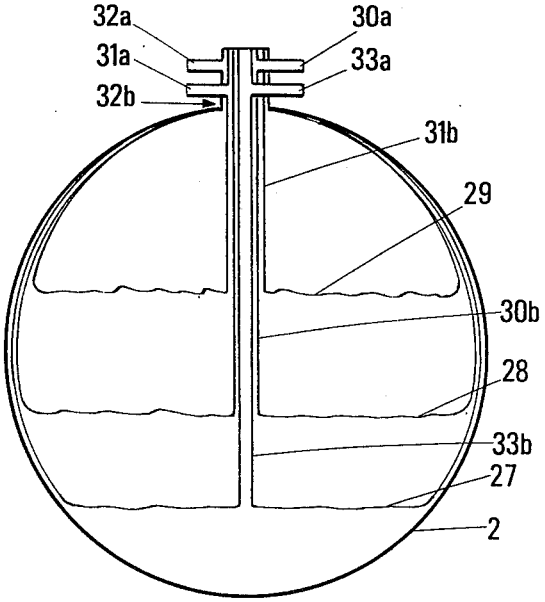
Figure 2A:
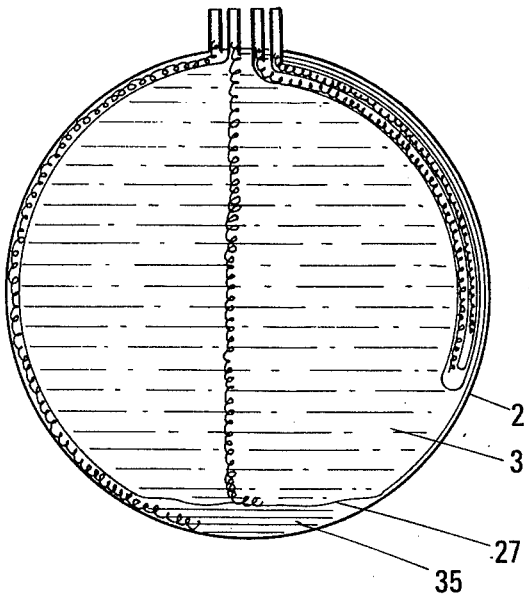
Figure 4:
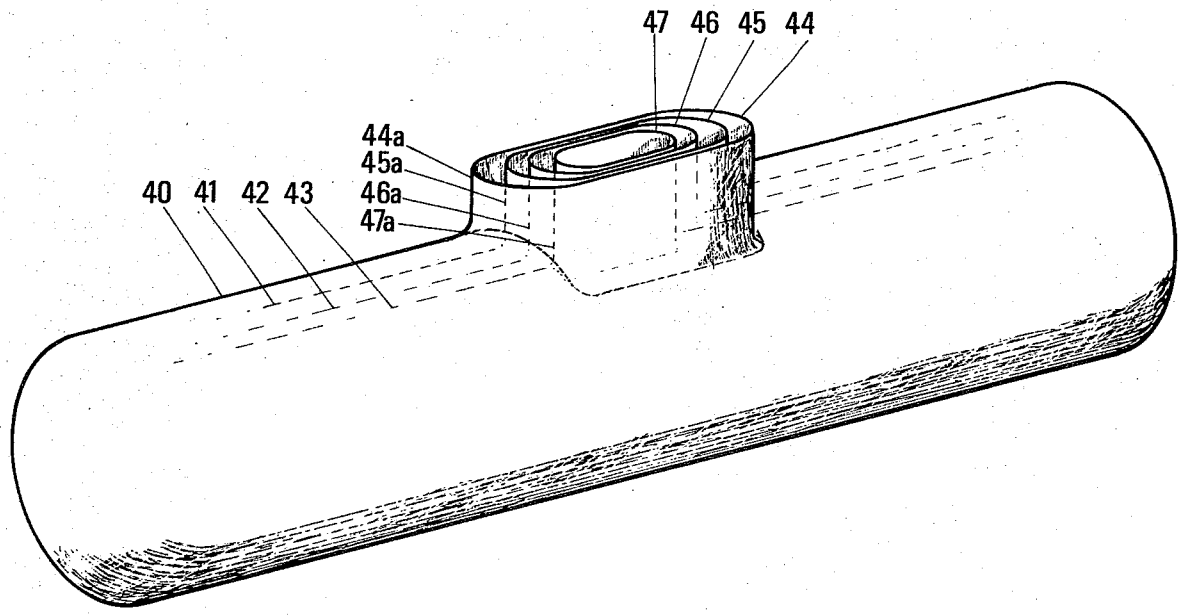
Figure 5:
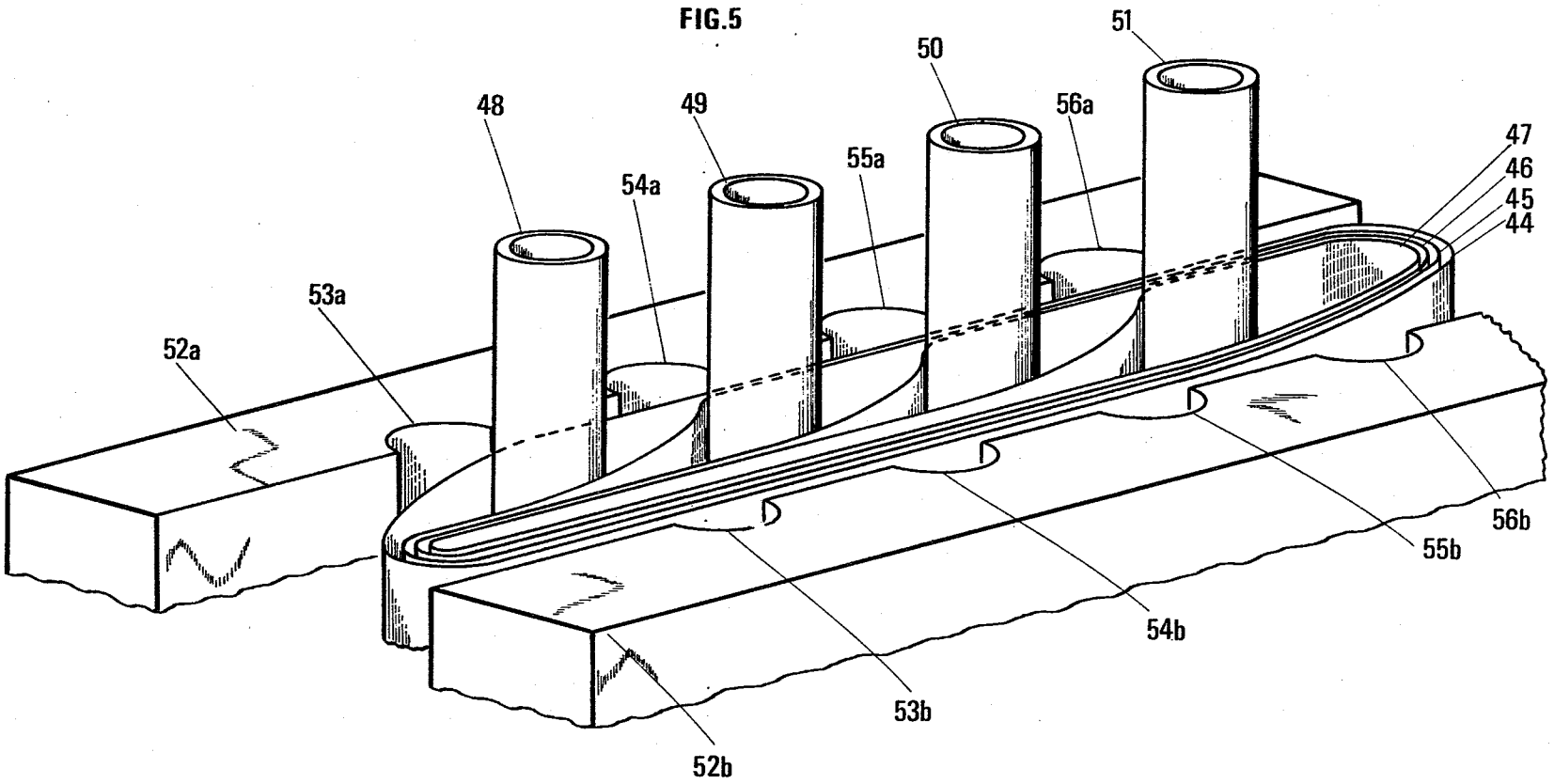
Figure 6:
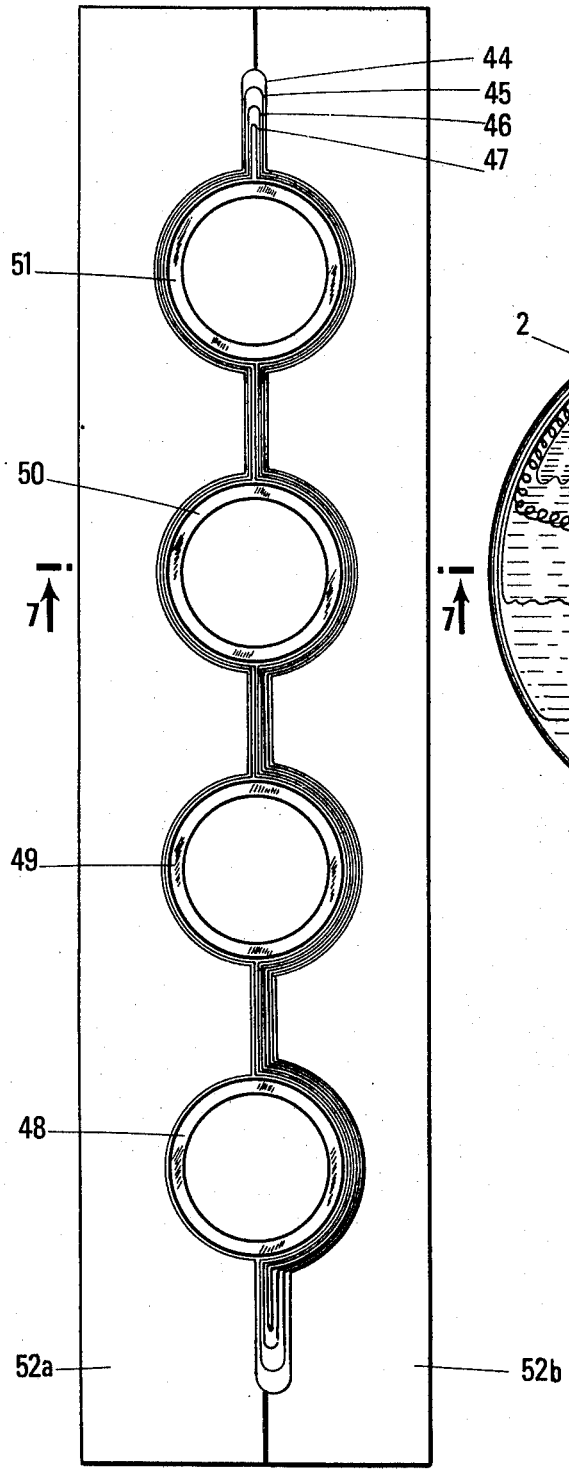
FIG. 6 is an upper view of the connecting means which is then made solid with the container 2 (not shown in FIGS. 4 to 7).
Figure 7:
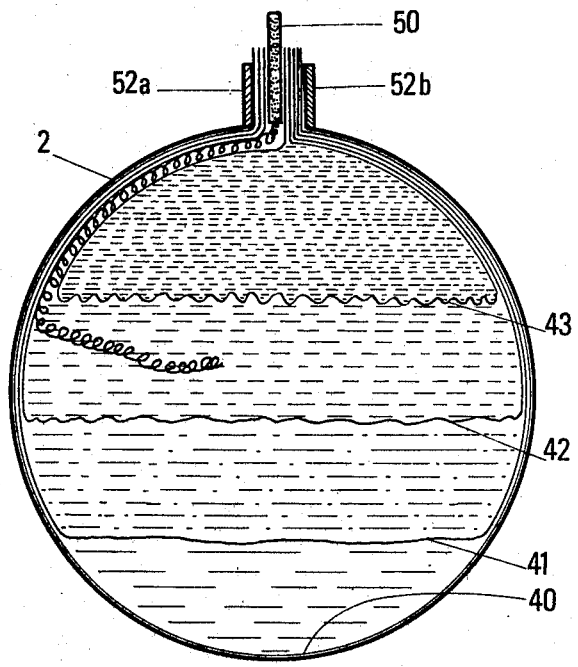
FIG. 7 is a cross-section along line 7—7 of FIG. 6 of the tank structure in which appears the pipe 50 for the supply to and the discharge from the ba 42 of the stored fluid.

For example, the auxiliary chamber, instead of being formed either between the internal wall of the container (FIG. 2) or between the outer bag 40 and the adjacent bag 41 located inside this outer bag (FIGS. 4 and 7), may optionally be formed by anyone of the bags, for example by the innermost of said bags (such as bag 29 in the embodiment of FIG. 2 and bag 43 in the embodiment of FIG. 7).

What we claim is:

1. A tank for the storage and distribution of a plurality of fluids comprising a container, a plurality of flexible bags housed in said container and formed by membranes of very small stiffness, each flexible bag being sized sufficiently large to substantially fill the entire internal volume of said container when filled with fluid, said plurality of flexible bags being arranged one inside the other so as to define a plurality of variable volume chambers including an auxiliary chamber and a plurality of storage chambers, said plurality of variable volume chambers separated from one another by said membranes whereby the pressures of the fluids in the different variable volume chambers are substantially equalized, said auxiliary chamber maintaining the fluids in said storage chambers under substantially steady pressure, wherein the auxiliary chamber is formed between the outermost flexible bag and the bag adjacent to said outermost bag, each flexible bag being provided with an inlet sleeve, the inlet sleeves on the respective flexible bags surrounding one another, said tank further comprising a plurality of duct means, one of said duct means having an end portion communicating with the auxiliary chamber between the sleeve on the outermost flexible bag and the sleeve of the adjacent bag, another of said duct means having an end portion communicating with the innermost chamber and being surrounded by the sleeve connected to the innermost flexible bag, and at least one other duct means connected to at least one intermediate chamber between adjacent sleeves of adjacent flexible bags.

2. The tank of claim 1, further comprising connecting means constituted by at least two complementary elements for providing a tight connection between the respective flexible bags and the corresponding duct means.

3. The tank of claim 2, further including inlet and outlet valve means connected to said duct means for controlling the flow of fluid into and out of said chambers.

4. The tank of claim 1, wherein all of said intermediate chambers are provided with duct means.

5. The tank of claim 1, wherein said auxiliary chamber is the outermost chamber.

6. A tank for storage and distribution of a plurality of fluids comprising a housing, a plurality of flexible bags in said housing formed by membranes of very small stiffness, each flexible bag being sized sufficiently large to substantially fill the entire internal volume of said housing when filled with fluid, said plurality of flexible bags being arranged one inside the other so as to define a plurality of variable volume chambers, said plurality of variable volume chambers separated from one another by said membranes whereby the pressures of the fluids in the different variable volume chambers are substantially equalized, one of said variable volume chambers being an auxiliary chamber connected to a source of pressurized auxiliary fluid so that said variable volume chambers are maintained under substantially steady pressure, said tank further comprising supply and discharge means attached to said plurality of bags for supplying and discharging fluids stored in said chambers, wherein said supply and discharge means comprises a plurality of duct means spaced from one another, each duct means including an end portion inserted into a respective chamber, said supply and discharge means further including connecting means including two complementary elements for providing a tight connection between each chamber and its corresponding duct means.

7. The tank of claim 6, wherein the inner wall of said housing and the outermost flexible bag define therebetween outermost chamber, wherein the innermost flexible bag defines an inner chamber, and wherein said plurality of flexible bags define at least one intermediate chamber, each intermediate chamber being defined by the walls of successive flexible bags.

8. The tank of claim 6, wherein said duct means are arranged coaxially, each duct connected to a different chamber.

9. The tank of claim 1, further including inlet and outlet valve means connected to said duct means for controlling the flow of fluid into and out of said chambers.

10. The tank of claim 5, wherein said flexible bags are elastic.

11. The tank of claim 6, wherein said flexible bags are resistant to hydrocarbon degradation.

12. The tank of claim 11, wherein the bag or bags defining the auxiliary chamber comprise a composite membrane formed from a waterproof layer and a hydrocarbon-proof layer.

13. The tank of claim 6, wherein the walls of said flexible bags are about 20 to 500 microns thick.

14. The tank of claim 13, wherein the walls of said flexible bags are about 50 to 150 microns thick.

15. The tank of claim 6, wherein each flexible bag is provided with an inlet sleeve, the inlet sleeves on the respective flexible bags surrounding one another.

16. The tank of claim 15, wherein said plurality of duct means have one of said duct means communicating with each chamber via said sleeves.

17. The tank of claim 15, wherein the innermost sleeve surrounds one of said duct means and wherein a second duct means communicates with the chamber formed between the inner wall of said housing and the exterior wall of the outermost flexible bag.

18. The tank of claim 17, wherein a third duct means communicates with a variable volume chamber between two adjacent inlet sleeves.

19. The tank of claim 6, wherein said outermost chamber is connected to means supplying pressurized water, the flexible bag limiting said outermost chamber comprising a composite membrane formed from a water-proof layer and a hydrocarbon-proof layer.

* * * * *